US006460281B1

(12) United States Patent
Schaeffer

(10) Patent No.: US 6,460,281 B1
(45) Date of Patent: Oct. 8, 2002

(54) SINGLE TRIGGER SEQUENTIAL FIRING MECHANISM FOR A DOUBLE BARREL FIREARM

(76) Inventor: David Schaeffer, 3235 Old York Rd., Whitehall, MD (US) 21161

( * ) Notice: Subject to any disclaimer, the term of this patent is extended or adjusted under 35 U.S.C. 154(b) by 0 days.

(21) Appl. No.: 09/944,129

(22) Filed: Sep. 4, 2001

(51) Int. Cl.[7] ..... F41A 19/21

(52) U.S. Cl. ..... 42/42.01; 42/2; 42/12; 42/41; 42/69.01

(58) Field of Search ..... 42/42.01, 41, 12, 42/69.01

(56) References Cited

U.S. PATENT DOCUMENTS

| | | | | |
|---|---|---|---|---|
| 3,131,499 A | | 5/1964 | Arsenault | |
| 3,389,488 A | | 6/1968 | Beretta | |
| 3,421,243 A | | 1/1969 | Browning | |
| 3,537,203 A | | 11/1970 | Weatherby et al. | |
| 3,650,174 A | * | 3/1972 | Nelsen | 89/28 |
| 3,731,416 A | * | 5/1973 | Semple | 42/42 R |
| 3,808,724 A | * | 5/1974 | Linde | 42/42 R |
| 3,861,069 A | * | 1/1975 | Heurlen | 42/1 Y |
| 4,026,056 A | * | 5/1977 | Roman | 42/69 R |
| 4,265,044 A | | 5/1981 | Beretta | |
| 4,310,981 A | | 1/1982 | Waddell | |
| 4,328,635 A | * | 5/1982 | Klavestad | 42/12 |
| 4,380,881 A | * | 4/1983 | Klavestad | 42/42 R |
| 4,545,143 A | | 10/1985 | Schultz | |
| 4,577,430 A | * | 3/1986 | Ruger et al. | 42/69 R |
| 4,625,444 A | * | 12/1986 | Beretta | 42/69.02 |
| 5,421,114 A | | 6/1995 | Bond et al. | |
| 5,709,046 A | * | 1/1998 | Canaday | 42/69.01 |

FOREIGN PATENT DOCUMENTS

| | | |
|---|---|---|
| GB | 524641 | 8/1940 |

* cited by examiner

*Primary Examiner*—Charles T. Jordan
*Assistant Examiner*—Bret C Hayes

(57) ABSTRACT

A single trigger sequential firing mechanism for a double barrel firearm fires the two barrels or chambers successively upon successive trigger actuation, without need for a separate selector switch. The firing pins are driven by linear motion of corresponding pistons or plungers, rather than by arcuate motion of pivoting hammers. The present invention is adaptable to various double barrel gun configurations, but is particularly adaptable for use with over and under double barrel shotguns. Three different embodiments are disclosed, with each having identical parts and components with the exception of the upper portion of the trigger body. The first embodiment fires the two barrels successively upon successive pulls of the trigger. The second embodiment fires the two barrels after a first trigger pull and a subsequent release of the trigger. Finally, a third embodiment fires the two barrels upon successive trigger releases, after the trigger has been pulled.

18 Claims, 19 Drawing Sheets

SINGLE TRIGGER SEQUENTIAL FIRING MECHANISM FOR A DOUBLE BARREL FIREARM

BACKGROUND OF THE INVENTION

1. Field of the Invention

The present invention relates generally to small arms, and more particularly to a double barrel firearm (e. g., shotgun) incorporating a single trigger action for sequentially firing both barrels. The present invention includes three separate embodiments, differing in the trigger structure. These embodiments enable the two barrels to be fired upon two consecutive pulls of the trigger, or pulling and then releasing the trigger, or upon two consecutive releases of the trigger after it has been pulled. The present invention is particularly adapted for use with over—under double barreled shotguns, but may be adapted to side by side double barrel shotguns, or other firearms incorporating two gun barrels.

2. Description of the Related Art

The earliest firearms incorporated relatively primitive reloading means, in which separate powder, wad, and ball charges were inserted from the muzzle end of the barrel. The desire to fire more rapid consecutive shots is obvious in such weapons, and as a result multiple barrel firearms were developed before the invention of chamber loading weapons utilizing self-contained cartridges and shot or rounds.

While present day firearm technology has provided semi-automatic and fully automatic small arms, many hunters and shooters still prefer double barreled firearms for various reasons. While double barreled weapons tend to be heavier than single barreled guns, and obviously limit the number of shots to the number of barrels of the firearm, they also have certain advantages. Among these are the greater stiffness provided by the two joined barrels and, to some shooters, the greater barrel mass which may assist the shooter in smoothly swinging the gun to align with a target. Trap and skeet shooters particularly often favor double barrel shotguns for use in their sport.

Nearly all such double barrel shotguns utilize two separate triggers, each of which trips a separate sear, hammer, and firing pin to fire one of the two chambers of the gun. Conventionally, each trigger is pulled to actuate the cocked mechanism in order to fire the respective chamber of the gun. More recently, competitive shooters have recognized the value of other mechanisms, such as linearly traveling pistons for driving the firing pins, rather than arcuately pivoting hammers. The use of pistons to drive the firing pins results in somewhat faster actuation of the mechanism. In addition, various multiple barrel mechanisms have been developed which utilize only a single trigger, and some means for selecting which barrel is to be fired using the single trigger. Such prior art mechanisms still require the manipulation of two different devices, whether a trigger and selector switch, or two triggers.

Some shooters have also recognized the potential inaccuracies which may occur in firing a weapon having a conventional pull-type trigger. The sudden muscular contraction required to produce the trigger pull, may be sufficient to throw off the aim of the firearm to some slight extent, which is often sufficient to cause the target to be missed. While this is more true of rifle and pistol shooting than shotgun shooting, it nevertheless can also apply to competitive skeet and trap shooting, as well as hunting with such firearms.

The present invention recognizes the various problems noted and described above, and provides a solution to these problems in the form of a double barrel firearm having only a single trigger for sequentially firing both chambers of the gun as desired. Rather than incorporating a separate selector switch for selecting the chamber and barrel to be fired, the present mechanism uses a sophisticated mechanical linkage to fire each barrel sequentially as the trigger is pulled, or in some embodiments, as the trigger is released after a pull. This trigger release firing system can provide significant advantages for the competitive shooter, in the form of smoother and more precise gun handling. Moreover, the present firearm mechanism incorporates piston actuation of the firing pins in order to provide more rapid firing action, as is desirable in the sport.

A discussion of the related art of which the present inventor is aware, and its differences and distinctions from the present invention, is provided below.

U.S. Pat. No. 3,131,499 issued on May 5, 1964 to Amedee J. Arsenault, titled "Action For Double Barrel Firearms," describes a single trigger mechanism for selectively firing both chambers or barrels of an over—under double barrel gun. (Arsenault discloses a double barreled, break action rifle in his '499 U.S. Pat.). However, Arsenault requires a separate selector switch which operates to lock one or the other firing pin in its rearward position, thereby allowing only a single barrel to be fired. If the trigger is pulled again without switching the separate switch, the gun will not fire because that firing pin has already been released from its cocked position for firing that chamber upon the first trigger pull, and the cartridge in the chamber has been expended. Thus, the selector switch must be manipulated each time it is desired to fire the second barrel of the Arsenault gun. This does not appear to provide any advantage over the conventional two trigger mechanism for double barreled guns, as Arsenault merely moves the manipulation of a second trigger to a separate selector switch extending from the top rear of the action, and requires that the shooter manipulate that separate selector switch for firing the second chamber. Moreover, the Arsenault trigger only operates upon a pull stroke, and cannot fire the weapon upon trigger release. In contrast, the present invention utilizes two separate pistons which are in turn separate from their corresponding firing pins, and provides only a single trigger for sequential firing of the two chambers and barrels of a double barrel firearm, using one or more pull or release strokes of a specific trigger configuration.

U.S. Pat. No. 3,389,488 issued on Jun. 25, 1968 to Carlo P. Beretta, titled "Single-Trigger Release Mechanism For A Double-Barreled Shotgun," describes a mechanism wherein a selector switch is used to select the first barrel or chamber desired for firing, with the mechanism then automatically switching to trip the second or previously unreleased hammer to fire the second chamber. In the event of a misfire of the first selected shell, the mechanism does not automatically switch. Rather, the shooter must manually use the selector switch to switch to the previously unselected second barrel or chamber, whereupon a pull of the single trigger releases the second hammer to fire the second chamber. This differs from the mechanism of the present invention in several ways: (a) Beretta uses pivotally acting hammers, rather than linearly acting pistons or plungers (as in the present invention) to strike the firing pins; (b) the Beretta mechanism requires a selector switch, whereas no selector switch is required in the present single trigger mechanism; and (c) the present mechanism is not dependent upon any inertial mechanism, but automatically switches from the first to the second chamber and shell regardless of whether or not the first chamber fires.

U.S. Pat. No. 3,421,243 issued on Jan. 14, 1969 to Val A. Browning, titled "Firing Mechanisms For Double Barrel, Single Trigger Firearms," describes a gun having a three way selector switch, with the central position serving as a safety and the left and right positions serving to select the corresponding hammer for firing the respective chamber of the gun. The mechanism includes an inertial mass which is tripped or actuated upon recoil and counter-recoil of the gun after firing the round in the first chamber. The fall of the first hammer trips a sear, whether the round actually fires or not, which then allows the second hammer to be tripped sequentially upon the next trigger pull. In contrast, the present mechanism does not require a selector switch, but always fires one barrel (e. g., the lower barrel, in an over and under double barrel gun) before the other. The present mechanism is far simpler, as no inertial weights, counterweights, etc. are required for operation. Rather, the present mechanism utilizes a distinct trigger body configuration to trip a piston or plunger upon a pull (or release, depending upon the embodiment) of the trigger, with a subsequent pull (or release) firing the second round.

U.S. Pat. No. 3,537,203 issued on Nov. 3, 1970 to Roy E. Weatherby et al., titled "Multiple Barrel Firearm Having Barrel Selection Means Responsive To Counter Recoil," describes a double barrel gun having a barrel selector switch disposed immediately in front of the trigger, within the trigger guard and beneath the action frame or housing. In addition, Weatherby et al. include an inertial mechanism for readying the second chamber or round for firing, but also provide means for firing the second chamber even though the first chamber misfires. The Weatherby et al. mechanism is thus more closely related to the mechanism disclosed in the Browning '243 U.S. Pat. with its hammer and inertial recoil mechanisms, than to the present invention.

U.S. Pat. No. 4,265,044 issued on May 5, 1981 to Pier C. Beretta, titled "Double-Barrel Shotgun," describes a shotgun action having dual hammers and corresponding dual triggers for firing each chamber or barrel independently of the other as desired. The disclosure is directed to a mechanism for ensuring that the hammers do not move forward to contact the associated firing pins when the firearm is not fully cocked and closed. While only a single hammer and trigger mechanism is shown, the Beretta '044 U.S. Pat. is directed to firearms having completely independent, dual firing mechanisms, and no selector means or means of firing both barrels or chambers using a single trigger, is disclosed.

U.S. Pat. No. 4,310,981 issued on Jan. 19, 1982 to Richard D. Waddell, titled "Selective Trigger Unit For Multiple Barrel Firearms," describes a mechanism having a selector switch immediately in front of the trigger and within the trigger guard, as in the mechanism of the Weatherby et al. '203 U.S. Pat. discussed further above. However, the Waddell mechanism is somewhat simpler, in that it does not include any inertial means for switching the firing action from one barrel to another upon recoil of the firearm from firing the first selected barrel. The Waddell selector switch operates to select the first barrel or chamber to be fired, with the mechanism then automatically switching to the unfired second barrel for the next shot. Waddell does not disclose any completely automated sequential firing mechanism, nor means for firing the firearm when the trigger is released, as provided by embodiments of the present invention.

U.S. Pat. No. 4,545,143 issued on Oct. 8, 1985 to Mitchell D. Schultz, titled "Trigger Mechanism For Double Barrel Shotgun," describes a side by side double barrel firearm in which two side by side hammers are used to fire the respective chambers of the gun, rather than linearly traveling pistons, as in the present invention. The hammers are selectively actuated by a double pull trigger mechanism which uses a recoil actuated inertia block to switch actuation from one hammer to the other. Schultz also provides a cam which interferes with the recoil operation of the inertia block to ensure that the inertia system cannot trip the second hammer with only a single trigger pull. The Schultz disclosure also reveals a selector switch for selecting which chamber of the gun is to be fired by the single trigger mechanism, but the manually actuated selector switch is disabled when the Schultz mechanism is installed in the disclosed double barrel gun. The Schultz mechanism is directed particularly toward skeet and trap shooting, where double barreled guns are popular due to the occurrence of "doubles," or two targets, being launched simultaneously. It is important to note that while Schultz does provide a mechanism for sequentially firing the two chambers of a double barrel gun using only a single trigger, his mechanism is adaptable only to side by side double barrel guns, due to the arrangement of the hammers and other mechanisms involved. Moreover, the levers, pawls, ratchets, etc. incorporated with the Schultz mechanism are not adaptable for use in a gun wherein the firing pins are driven by linearly traveling pistons, as in the present invention. In addition, the Schultz mechanism is relatively complex in comparison to the mechanism of the present invention, and still lacks the versatility of the present firing mechanism which enables the two chambers to be fired using two successive pulls of the trigger, or alternatively a pull and release or two successive releases of the trigger, with the mechanism of the present inventive embodiments differing only in the configuration of the upper portion of the trigger body.

U.S. Pat. No. 5,421,114 issued on Jun. 6, 1995 to Gregory E. Bond et al., titled "Gun With Improved Barrel Locking Means And Rebounding Hammer," describes a small, over and under type double barrel pistol of the Derringer type. Bond et al. provide various safety features for such a pistol, e. g., means for retracting the hammer away from the chambers during opening and reloading of the gun, etc. However, Bond et al. do not specify any means for firing either chamber specifically using the single trigger of the gun, as evidenced in column 3, line 67, i. e., "The hammer head 60 strikes one of the firing pins, . . . ".

Finally, British Patent Publication No. 524,641 accepted on Aug. 12, 1940 to Societa Anonima Nazionale "Cogne," titled "Improvements In Automatic Breech Closing Mechanism For Firearms," describes a two part bolt mechanism and means for retaining the bolt due to recoil after firing. While the bolt mechanism is somewhat akin to the piston mechanism of the present firearm, it differs in that the firing pin is integral with the bolt mechanism, rather than being a separate component to be struck by the piston, as in the present mechanism. More importantly, no disclosure is made in the '641 British Patent Publication of any single trigger mechanism for firing two barrels in a multiple barrel gun, nor for firing each barrel by means of a double pull, pull and release, or double release action on the trigger, as provided by the present invention.

None of the above inventions and patents, taken either singly or in combination, is seen to describe the instant invention as claimed.

SUMMARY OF THE INVENTION

The present invention comprises a series of embodiments for sequentially firing the first and second barrels or chambers of a double barreled firearm using only a single trigger.

While the present invention may be adapted for use in virtually any practicable double barrel firearm, it is directed particularly to an over and under double barreled shotgun configuration. The mechanism of the present invention utilizes first and second linearly actuating pistons or plungers to strike the respective firing pins of the corresponding barrel chambers, rather than arcuately pivoting hammers. The use of linearly traveling pistons or plungers results in a more rapid firing of the weapon from the time the sear is released from the trigger until the firing pin strikes the primer of the cartridge or shell, than is possible with arcuately operating hammers.

Another advantage of the present firearm mechanism is the ability to fire either or both barrels of the double barreled gun by releasing the trigger, rather than only by pulling the trigger, as is the case in other firearms of the prior art. This is accomplished in different embodiments of the present invention by modifications to the upper portion of the trigger body, above the trigger pivot, with all of the remaining mechanism being identical between the different embodiments. The firing of the firearm upon trigger release can provide significant benefits, particularly in competitive shooting, where the muscle contraction required to pull the trigger can result in some slight misalignment of the gun with the desired aiming point. This is not the case when the trigger finger is relaxed to release the trigger to fire the gun.

Accordingly, it is a principal object of the invention to provide a single trigger, sequential firing mechanism for a double barrel firearm, with the mechanism requiring only actuation of the single trigger and being devoid of other manually operable selector switches and the like.

It is another object of the invention to provide such a sequential firing mechanism in which the firing pins are driven by linear motion of corresponding pistons or plungers, rather than by conventional pivotally moving hammers.

Still another object of the invention is to provide a sequential firing mechanism which is adaptable to various types of double barrel firearms, and particularly to over and under double barrel shotgun firearm configurations.

It is a further object of the invention to provide a single trigger firing mechanism for multiple barrel firearms including a series of embodiments, with a first embodiment successively firing the two barrels upon successive pulls of the trigger, a second embodiment successively firing the two barrels upon releasing the trigger after an initial pull and then again pulling the trigger, and a third embodiment successively firing the two barrels upon successive releases of the trigger after the trigger is twice pulled, with the mechanisms of each embodiment differing only in the configuration of the upper end of the trigger body.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
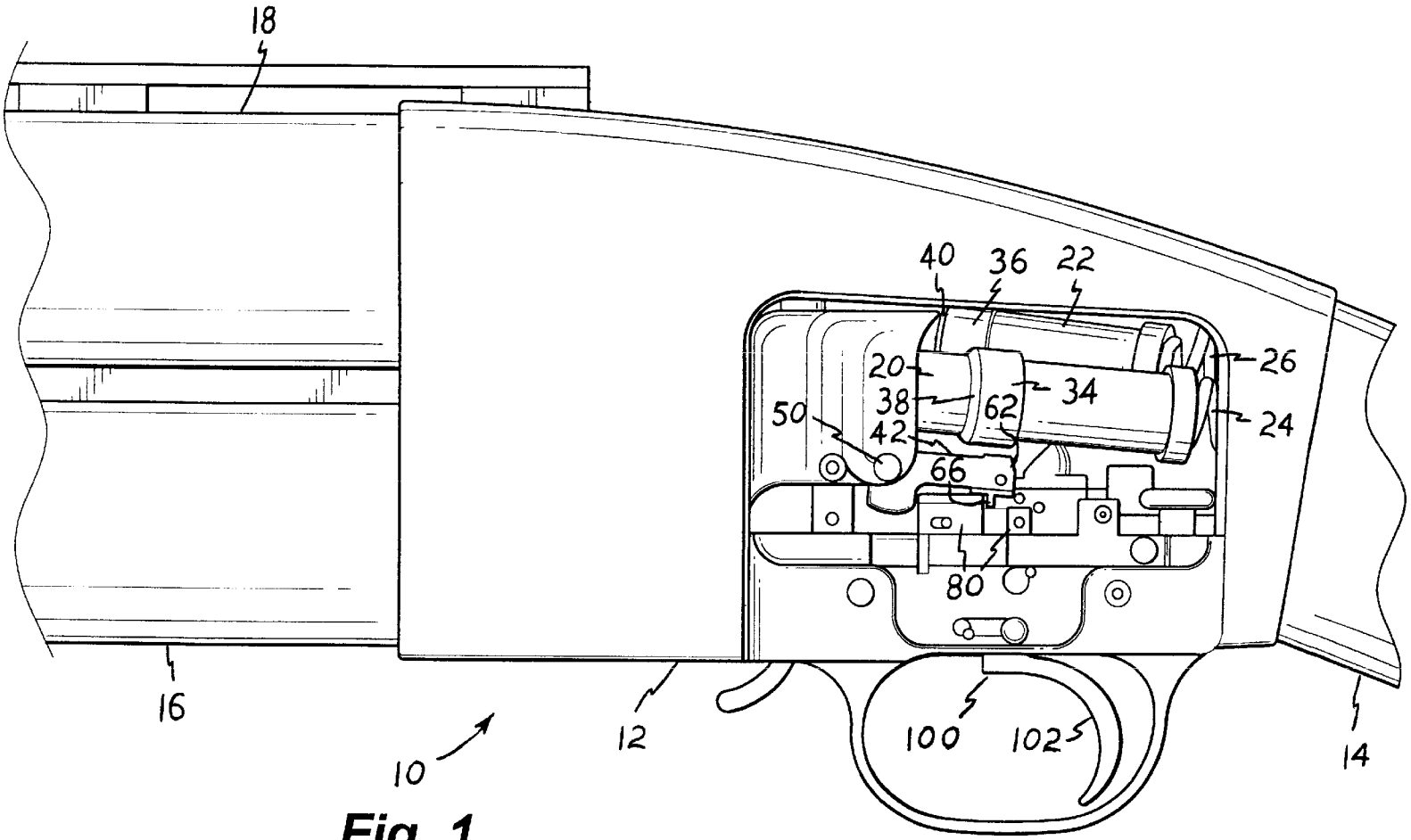
FIG. 1 is a broken away left side elevation view of the action or firing mechanism portion of an over and under shotgun incorporating the present invention, with the barrel extending to the left and the stock extending to the right.

The present invention comprises a single trigger, sequential firing mechanism for a double barreled firearm 10, the central action or frame 12 of which is shown in FIG. 1 of the drawings. The firearm 10 is outwardly conventional, having a rearwardly disposed stock 14 (a portion of which is shown in FIG. 1) and a first or lower barrel 16 and a second or upper barrel 18 (the rearward portions of which are shown extending from the central frame 12 in FIG. 1). While the two barrels 16 and 18 are arranged in an over—under configuration, the present invention is also adaptable to side by side double barrel guns as well. Moreover, while the present mechanism is of particular value for use with shotguns, it may also be adapted for use in rifles, as well.

The frame, housing, or action 12 includes a pair of spring loaded firing pin drivers, pistons, or plungers therein, respectively 20 and 22. The first or lower driver 20 is positioned to drive the first or lower firing pin (not shown), which in turn strikes the primer of a shell or cartridge chambered in the chamber of the first or lower barrel 16 of the firearm 10. The second, upper driver 22 is positioned to drive the second, upper firing pin (not shown), for striking the primer of a shell or cartridge loaded in the chamber of the second, upper barrel 18. The two firing pin drivers are driven forward linearly by respective first and second springs 24 and 26. It will be noted that the firing pin drivers 20 and 22 may be angularly positioned within the action 12, and need not be coaxially aligned with their respective barrels 16 and 18.

Figure 2:
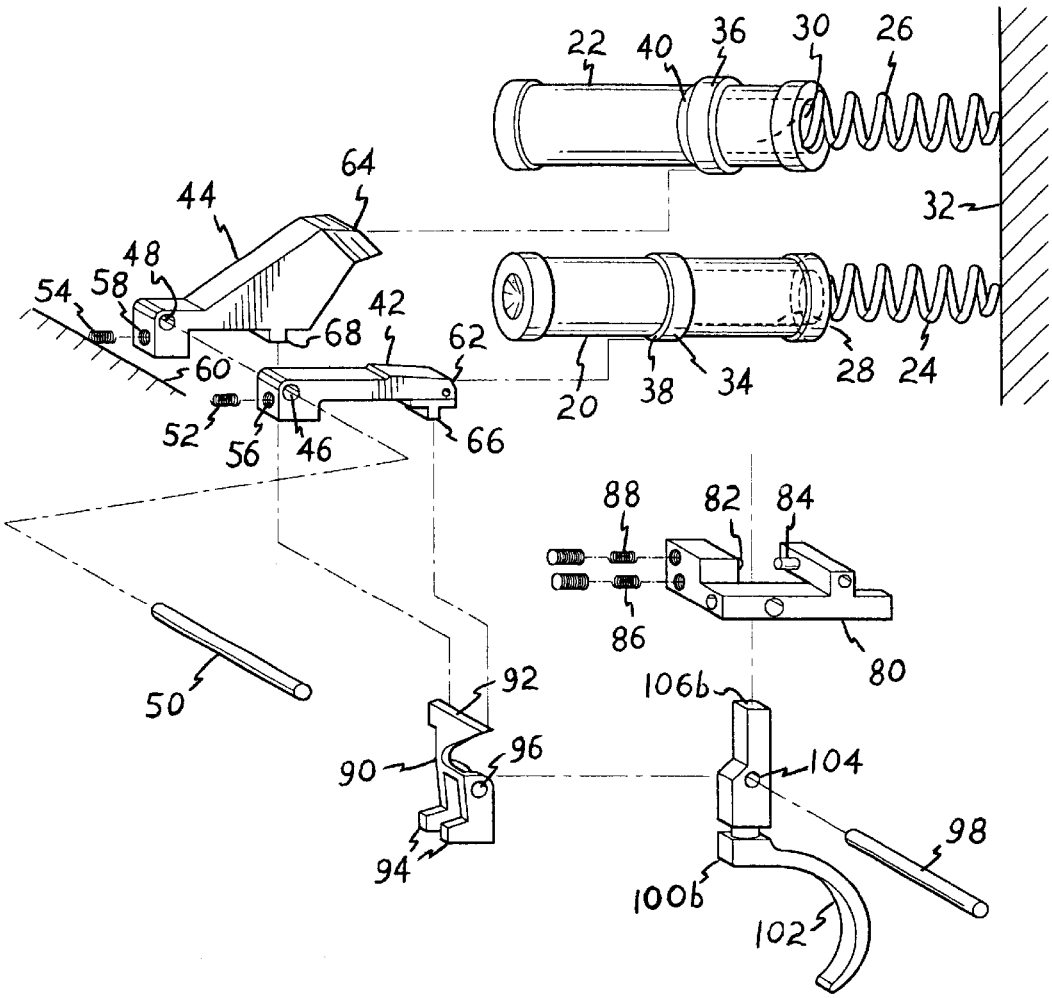
FIG. 2 is an exploded perspective view of the components comprising the various embodiments of the present invention, with the exception of the specific second embodiment trigger body.

FIG. 2 of the drawings provides an exploded perspective view of the basic components of the present sequential firing mechanism. The present invention includes three embodiments, providing for firing the two barrels 16 and 18 on two successive pulls of the trigger; a pull and then a release of the trigger; and two successive releases of the trigger, following corresponding trigger pulls. The mechanism differs only in the trigger configuration, and more particularly the upper portion of the trigger body above the pivot passage, with all other components being identical between each of the embodiments.

The two generally cylindrical firing pin pistons, plungers, or drivers 20 and 22 and their respective compression springs 24 and 26 are clearly shown in FIG. 2, with the drivers or pistons 20 and 22 being pushed rearwardly for cocking the firearm, compressing their respective springs 24 and 26 between the hollow spring seats 28 and 30 of each of the firing pin drivers 20 and 22 and the opposite immovable structure 32 within the rearward portion of the action or frame 12. The two drivers or pistons 20 and 22 each include a circumferential sear contact ring, respectively 34 and 36, disposed therearound, with the second sear contact ring 36 being somewhat more rearwardly disposed about its respective piston or plunger 22 than the first sear contact ring 34 on its piston 20, due to the relative forward and rearward positions of the two sears, as discussed further below. Each contact ring 34 and 36 also includes a forwardly facing, chamfered sear contact face, respectively 38 and 40, thereon.

Mutually independent first and second firing pin driver retaining sears, respectively 42 and 44, selectively engage the respective first and second pistons or plungers 20 and 22. Each sear 42 and 44 includes a laterally disposed pivot passage therethrough, respectively 46 and 48, through which a sear pivot pin 50 passes. The pin 50 is secured laterally within the fixed structure of the frame or action 12 of the firearm 10, as shown in FIG. 1. Each sear 42 and 44 is lightly biased or urged to a raised, piston engaging position by a small compression spring, respectively 52 and 54, disposed between respective spring receptacles 56 and 58 in the forwardly disposed pivot ends of the sears 42 and 44 and the fixed structure 60 of the frame or action 12.

Each sear 42 and 44 includes a rearwardly disposed firing pin driver or piston contact ring land, respectively 62 and 64, with the two lands 62 and 64 each having a cooperating chamfer for fitting against the respective chamfers 38 and 40 of the two firing pin drivers or pistons 20 and 22. When the two sears 42 and 44 are held in their raised positions, either by the sear springs 52 and 54 or by the trigger mechanism discussed further below, the two lands 62 and 64 of the sears 42 and 44 contact the respective chamfers 38 and 40 of the first and second firing pin drivers or pistons 20 and 22, thereby retaining the pistons or drivers 20 and 22 in their rearward positions against the pressure of the piston driver springs 24 and 26 when the gun is cocked, generally as shown in FIGS. 6A, 7A, 7B, 9A, and 9B.

Figure 3:
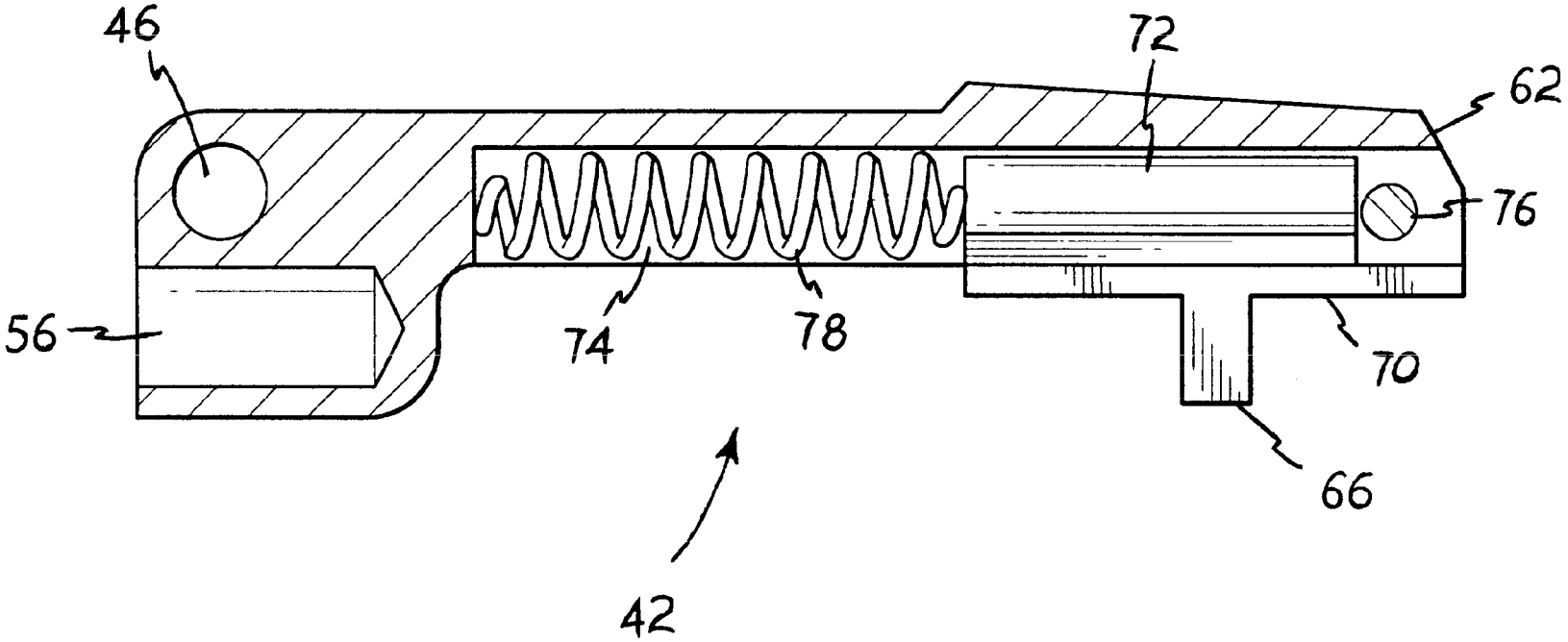
FIG. 3 is an enlarged left side elevation view in section of the first sear of the present firing mechanism embodiments, with its sliding tang.

The first and second driver retaining sears 42 and 44 each include a trigger engaging tang, respectively 66 and 68, extending downwardly therefrom. While the second tang 68 is an immovable monolithic part of the second sear 44, the first sear tang 66 is longitudinally slidable relative to its respective first sear 42, as shown in detail in FIG. 3. The sliding first sear tang 66 depends from a plate 70, which in turn depends from a small bolt 72 residing within a downwardly open longitudinal channel 74 formed in the first sear 42. A laterally disposed stop pin 76 extends across the rearward end of the channel 74, with a compression spring 78 biasing or urging the tang bolt 72 rearwardly against the stop pin 76. It will be seen that the first sear tang 66 may be displaced forwardly along the length of the first sear 42, when sufficient forward pressure is applied to the tang 66 to overcome the rearward bias of the spring 78. This sliding tang mechanism is common to each of the embodiments of the present firing mechanism invention, and its function is explained in detail further below.

A trigger body 80 having a squared, but generally U-shaped planform serves to contain the trigger components therein. This trigger body 80 is shown installed in the frame or action 12 of the gun 10 in FIG. 1, and is shown in detail in FIG. 2 of the drawings. The trigger body includes opposite forward and rearward trigger stop pins, respectively 82 and 84, a trigger return spring 86 for returning the trigger to a forward position, and a release catch return spring 88 for returning the release catch (described below) to a rearward position against the upper portion of the trigger.

A release catch 90 includes a relatively wide first and second sear tang land 92 at its upper end. The sear tang land 92 is sufficiently wide so as to selectively support both the first and second sear tangs 66 and 68 according to the action of the trigger. The release catch 90 further includes a pair of bifurcated lower extensions 94, which serve as counterweights during actuation of the mechanism. A pivot pin passage 96 is formed laterally and generally medially through the release catch 90, with a pivot pin 98 passing therethrough to serve as a pivot axis for the release catch 90 and for its associated trigger as well.

Figure 5:
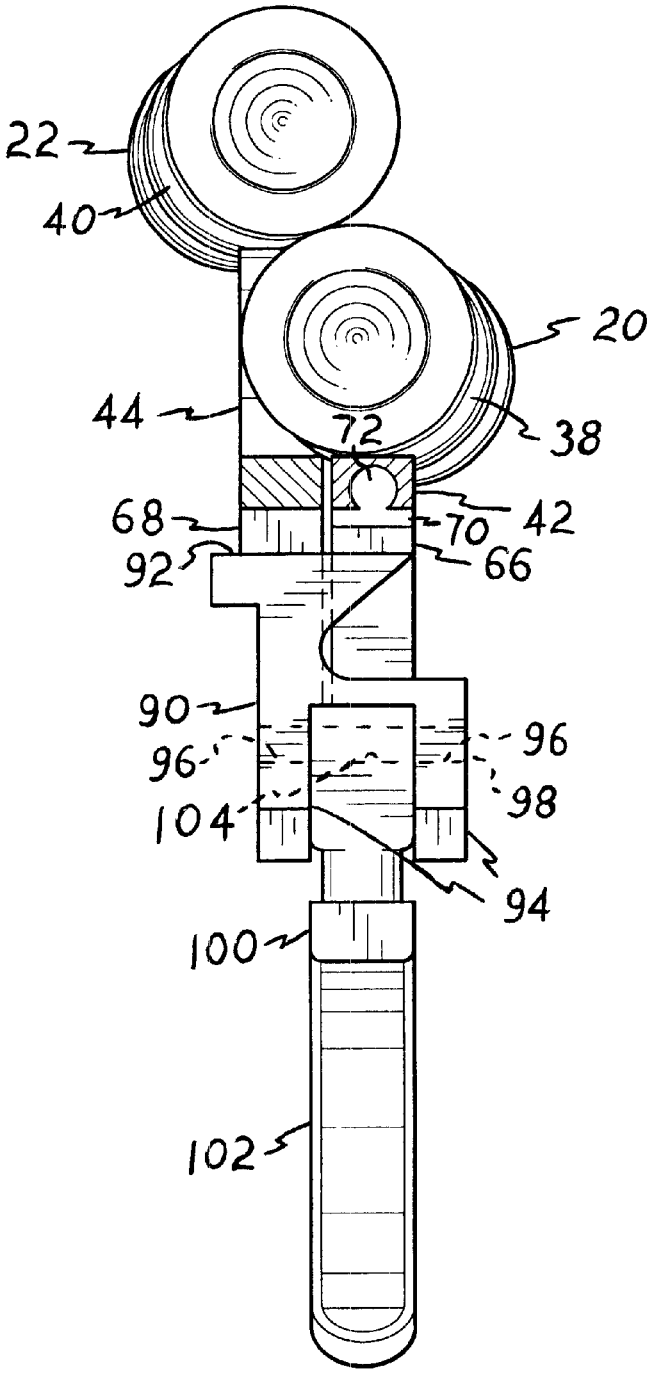
FIG. 5 is a front elevation view in partial section of the relationship of the piston or plunger assembly, the two sears and their piston engaging tangs, and other components of the mechanism.

The present firearm mechanism includes three different embodiments which enable the firearm to be fired upon two successive pulls of the trigger a pull and subsequent release of the trigger, or two successive releases of the trigger after the trigger is pulled twice successively, as disclosed further above. These three embodiments differ structurally only in the configuration of the trigger mechanism which is used with each embodiment; the remaining components 10 through 98 are identical for each embodiment. The trigger mechanism, designated generically by the reference numeral 100 and shown in FIGS. 1 and 5, includes a lower finger grip 102, a generally medial, lateral pivot pin passage 104, and an upper portion which engages with the first and/or second sear tangs 66 and 68. The numerically designated components are common between each of the trigger embodiments of the present invention, with the specific trigger embodiments being designated as triggers 100*a,* 100*b,* and 100*c.*

Figure 4:
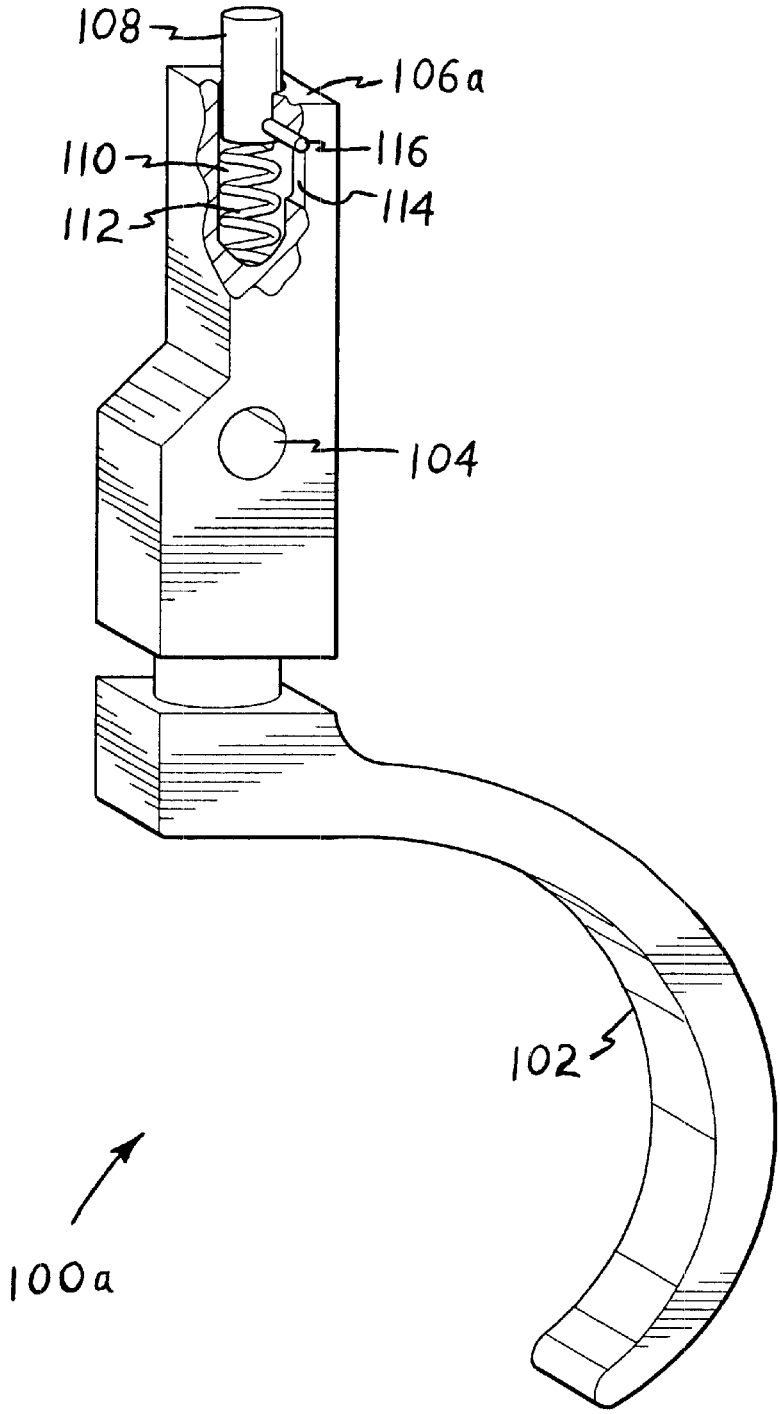
FIG. 4 is a perspective view of the first embodiment trigger body, with its upper portion partially broken away to show details of its mechanism.

FIG. 4 provides a detailed perspective view of a first "pull-pull" trigger embodiment 100*a,* with the upper portion partially broken away to show the mechanism. This trigger 100*a* is used with the first embodiment of the present invention, illustrated in FIGS. 6A through 6D and described further below. The trigger 100*a* has a lower finger grip portion 102 and a medial pivot pin passage 104, which features 102 and 104 are generic to each of the trigger embodiments 100*a,* 100*b,* and 100*c* of the invention. However, the upper end or first sear tang land 106*a* of the trigger mechanism 100*a* differs from others of the present invention, by having a retractable button 108 extending therefrom. The button 108 resides in a receptacle 110 concentrically formed in the upper portion of the trigger body 100*a,* with a trigger button extension spring 112 biasing or urging the button 108 to an extended position. The upper portion of the trigger body 100*a* includes a slot 114 in each side (one of which is partially shown in FIG. 4), with a laterally disposed pin 116 passing through the button and riding in the slots 114 to retain the button within the end of the receptacle 110.

Figure 6A:
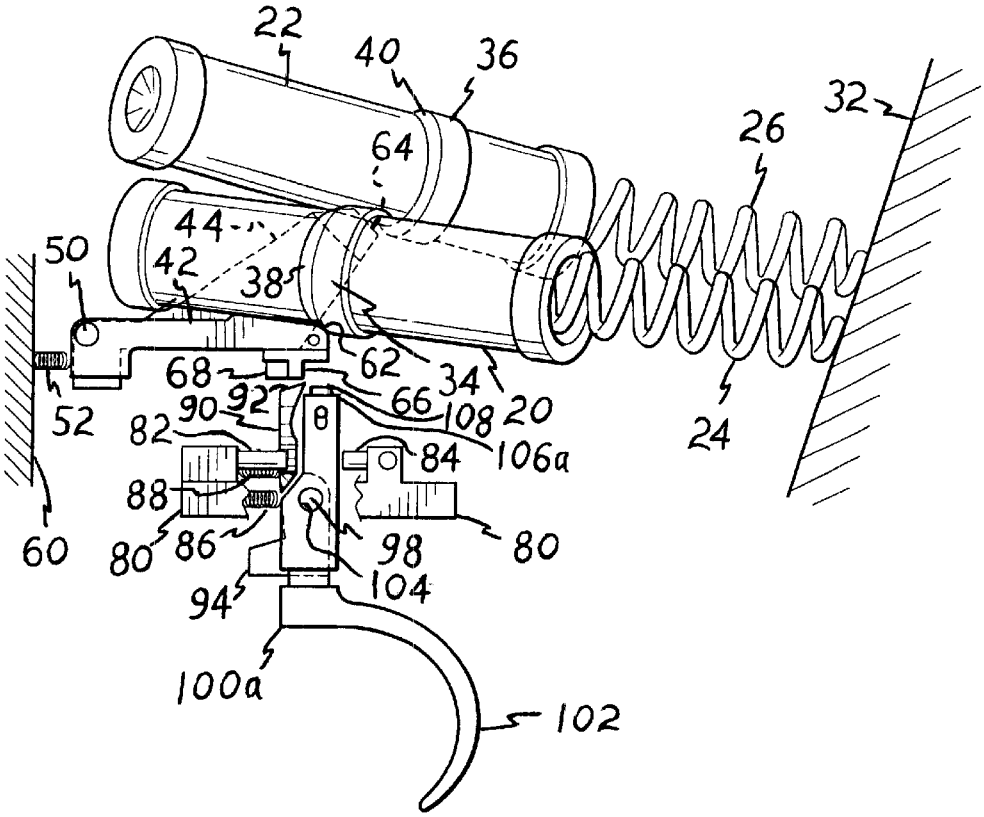
FIGS. 6A, 6B, 6C and 6D are side elevation views of the first embodiment firing mechanism, respectively showing the positions of the components when initially cocked, after a first trigger pull, after first trigger release, and after a second trigger pull.

FIGS. 6A through 6D illustrate the steps in the operation of the first embodiment of the present invention, incorporating the "pull-pull" trigger mechanism 100*a* of FIG. 4. In FIG. 6A, the mechanism is shown in its cocked condition, with both of the firing pin pistons or drivers 20 and 22 being rearwardly disposed against their respective compressed springs 24 and 26. The trigger finger grip 102 is in its forward position, with the opposite upper portion of the trigger 10*a* resting against the rear stop pin 84.

The release catch 90 is closely adjacent the upper portion of the trigger 100*a,* due to the return spring 88 which urges the release catch 90 toward the upper portion of the trigger 100*a*. The release catch 90 is pivotally secured to the trigger 100*a* by their common lateral pivot pin 98, as noted further above. The bifurcated lower legs or extensions 94 of the release catch 90 straddle the trigger body 100*a,* with the upper sear tang land 92 of the release catch 90 being positioned at substantially the same level or height as the top of the extended trigger button 108.

Figure 6B:
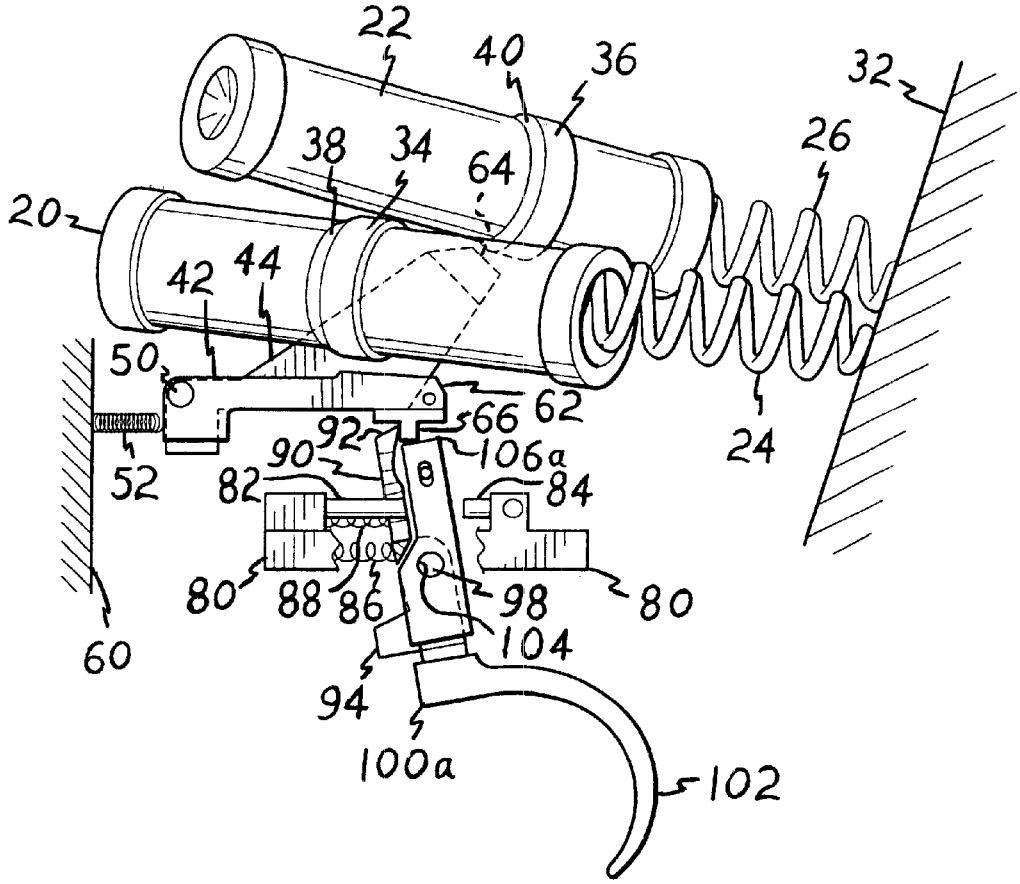

FIG. 6B illustrates the relative positions of the components when the "pull-pull" trigger mechanism 100*a* is initially pulled. When the trigger 100*a* is pulled rearwardly as shown, the upper portion pivots forwardly around the pivot pin 98. This pushes the upper end of the release catch 90 forwardly, along with its sear tang land 92, which moves forwardly of the first sear tang 66. When the first sear tang 66 is no longer supported by the release catch tang land 92, it pushes downwardly upon the spring loaded trigger button 108, thereby depressing or retracting the button 108 into the upper end of the trigger mechanism 1Oa. The pressure for accomplishing this downward movement of the first sear 42 and its tang 66 against the trigger button 108, is provided by the slope of the chamfered ring 34 of the first piston 20 bearing against the mating chamfered face 62 of the first sear 42. As the first sear tang 92 drops as the trigger button 108 is depressed, the first sear 42 also pivots downwardly, thereby releasing the first firing pin driver or piston 20 to fire the first barrel 16 of the firearm.

In FIG. 6B, the second sear tang 68 is concealed behind the lowered first sear tang 66 and the associated rearward end of the first sear 42. However, a review of FIGS. 2 and 6A clearly shows that the second sear tang 68 is on the order of twice as wide (in a longitudinal orientation) as the first sear tang 66. This results in the forwardmost portion of the second sear tang 68 continuing to rest atop the sear tang land 92 of the release catch 90, thereby maintaining the engagement of the second sear piston ring contact land 64 with its corresponding second piston ring chamfered edge 40, thereby continuing to hold the second firing pin driver or piston 22 in its cocked position, as shown in FIG. 6B.

Figure 6C:
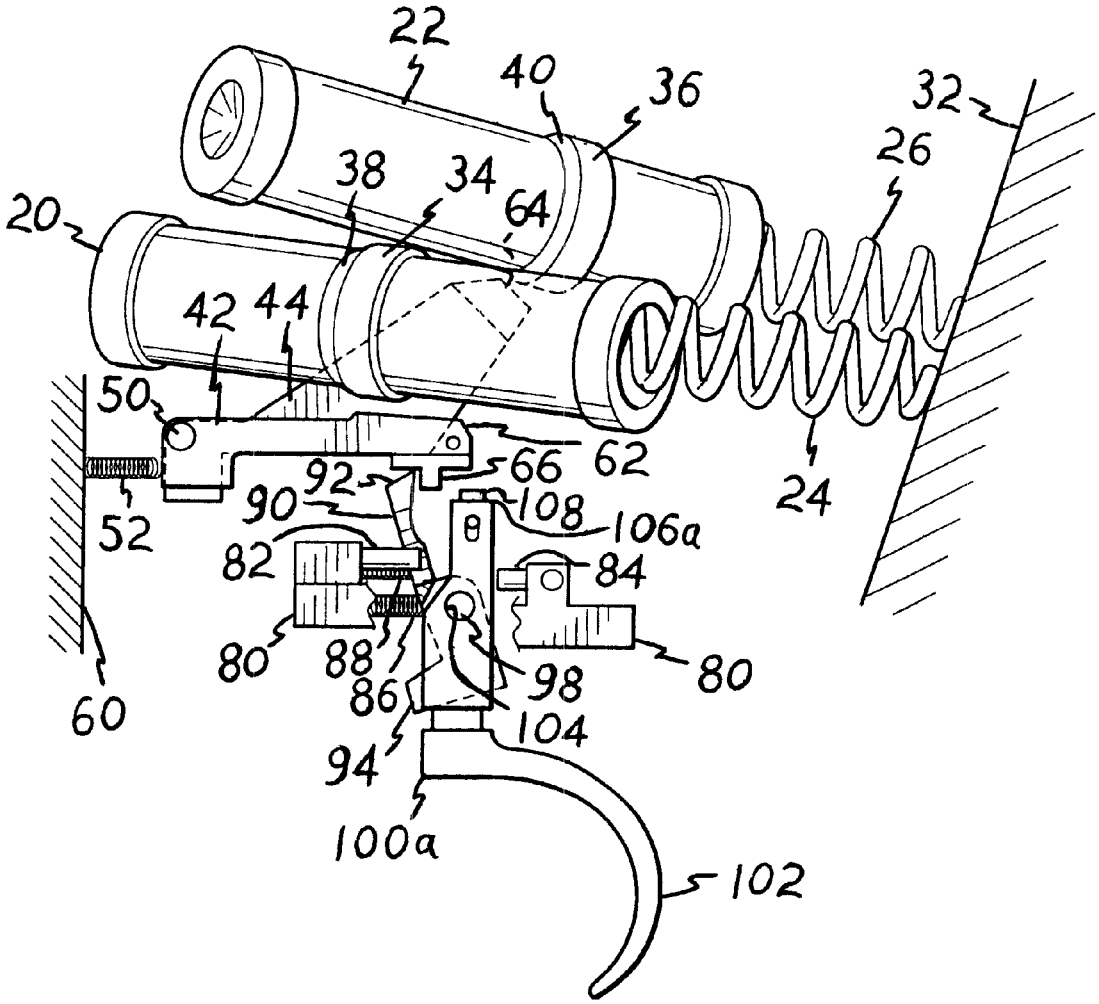

FIG. 6C illustrates the configuration when the trigger grip 102 is relaxed, with the trigger return spring 86 pushing the upper portion of the trigger assembly 100*a* rearwardly to push the trigger grip 102 forward. When this occurs, the trigger button 108 also moves rearwardly with the top of the trigger mechanism, and moves from beneath the first sear tang 66. This also allows the trigger button 108 to spring upwardly to its extended position, once it is clear of the first sear tang 66. However, since the first sear tang 66 had previously dropped, it is now below the upper edge of the sear tang land 92 of the release catch 90. This results in the first sear tang 66 retaining the sear tang land 92 of the release catch 90 in a forward position when the trigger 100*a* returns to its normal at rest position with the upper portion disposed rearwardly, with a gap being established between the trigger first sear tang land 106*a* and the sear tang land 92 of the release catch 90.

Figure 6D:
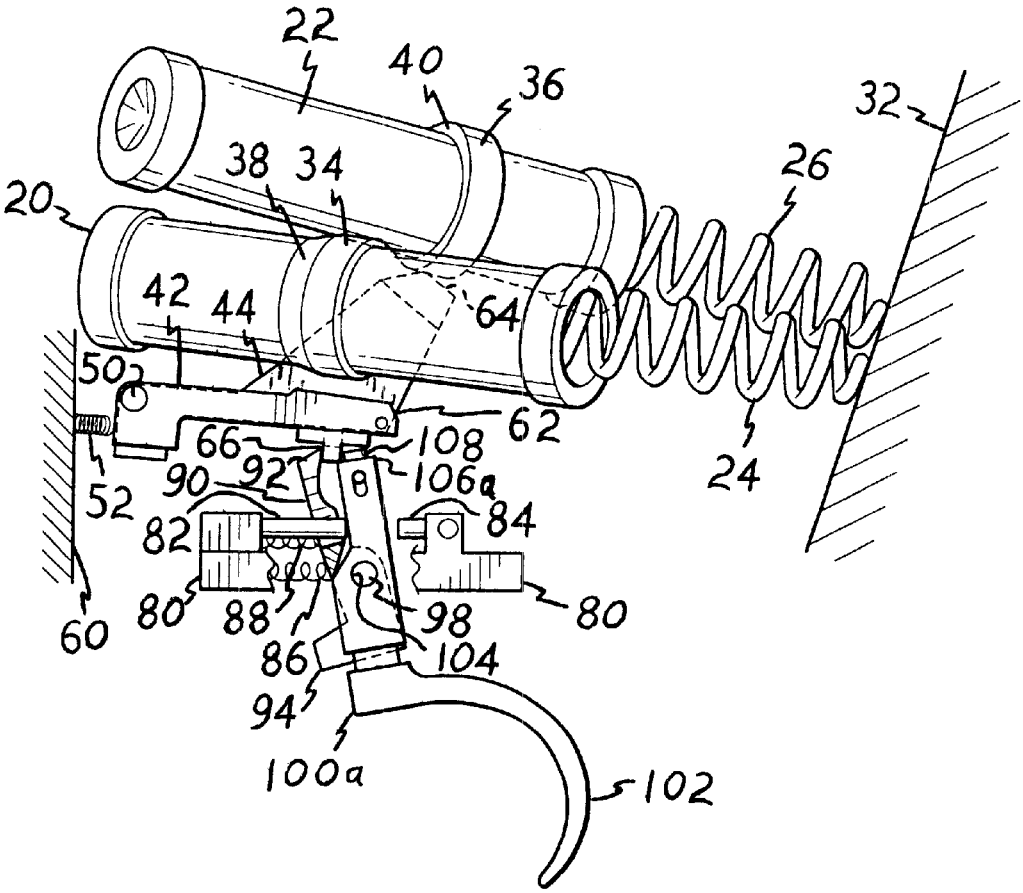

Finally, FIG. 6D illustrates the relationship of the components when the trigger grip 102 is pulled rearwardly for a second time. When this occurs, the now extended trigger button 108 contacts the back of the first sear tang 66, with the button 108 pushing the sliding first sear tang 66 forwardly in its channel 74 within the body of the first sear 42. As the first sear tang 66 moves forwardly, it also pushes the upper edge or sear tang land 92 of the release catch 90 forwardly, thereby pushing it from beneath the second sear tang 68 to allow the second sear tang 68 to fall to the rear of the release catch sear tang land 92. This results in the second sear 44 dropping, thereby releasing the second firing pin driver or piston 22 to fire the second barrel 18 of the firearm 10. The above described mechanism of the "pull-pull" trigger 100*a,* in combination with the remaining components of the present invention, results in the firing of one barrel of the double barreled gun upon each successive pull of the trigger grip 102, with no firing occurring upon release of the trigger grip 102.

A second embodiment is disclosed in FIGS. 7A through 7D, with a second "pull-release" trigger mechanism 100*b* being used in this second embodiment. The trigger mechanism 100*b* is relatively simple, and has no separate, moving parts, as does the first trigger embodiment 100*a*. This second trigger embodiment 100*b* is illustrated in the exploded perspective view of FIG. 2, with the relatively small view providing an adequate disclosure due to the simplicity of the trigger 100*b* and its plain, flat upper end or first sear tang land 106*b*.

Figure 7A:
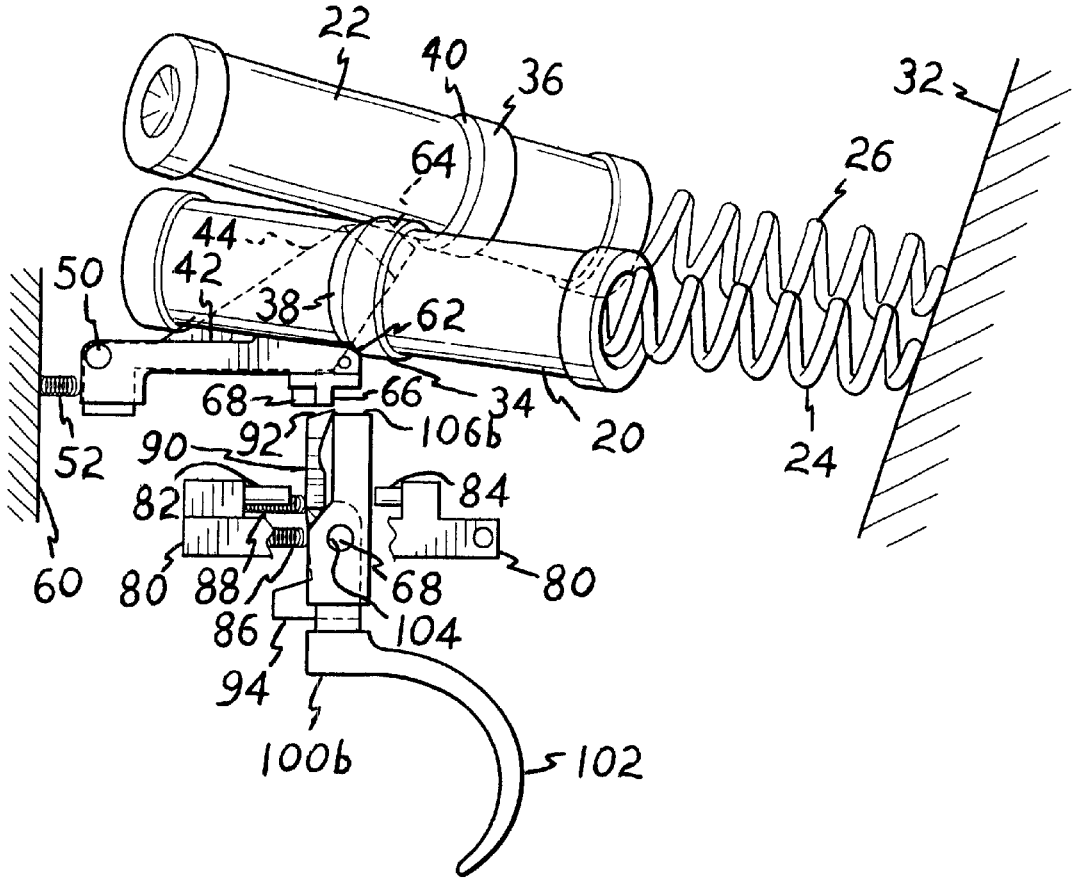
FIGS. 7A, 7B, 7C and 7D are side elevation views of the second embodiment firing mechanism, respectively showing the positions of the components when initially cocked, after a first trigger pull, after first trigger release, and after a second trigger pull.

In FIG. 7A, the mechanism is shown in its cocked condition, with both of the firing pin pistons or drivers 20 and 22 being rearwardly disposed against their respective compressed springs 24 and 26. The trigger finger grip 102 is in its forward position, with the opposite upper portion of the trigger 100*b* resting against the rear stop pin 84.

The release catch 90 is closely adjacent the upper portion of the trigger 100*b,* due to the return spring 88 which urges the release catch 90 toward the upper portion of the trigger 100*b*. The release catch 90 is pivotally secured to the trigger 100*b* by their common lateral pivot pin 98, as noted further above. The bifurcated lower legs or extensions 94 of the release catch 90 straddle the trigger body 100*b,* with the upper sear tang land 92 of the release catch 90 being positioned slightly above the flat first sear tang land 106*b* of the trigger 100*b,* i. e., with the release catch sear tang land 92 on the order of 0.02 inch (more or less) above the first sear tang land 106*b* of the trigger 100*b*.

Figure 7B:
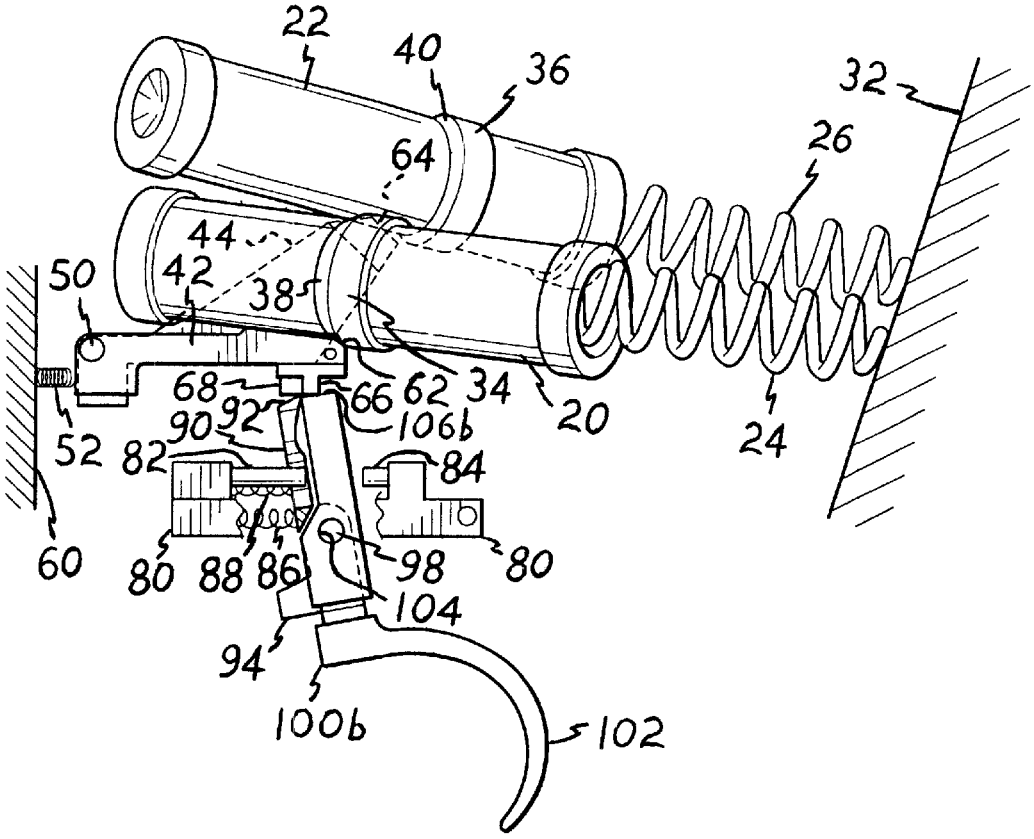

FIG. 7B illustrates the relative positions of the components when the "release-pull" trigger mechanism 100*b* is initially pulled. When the trigger 100*b* is pulled rearwardly as shown, the upper portion pivots forwardly around the pivot pin 98. This pushes the upper end of the release catch 90 forwardly, along with its sear tang land 92, which moves forwardly of the first sear tang 66. When the first sear tang 66 is no longer supported by the release catch tang land 92, it falls slightly to rest atop the first sear tang land 106*b* of the "release-pull" trigger 100*b*.

However, as the height of the first sear tang land end 106*b* of the "release-pull" trigger 100*b* is nearly the same as that of the sear tang land 92 of the release catch 90, the piston ring contact land 62 of the first sear 42 remains engaged with the chamfered edge 38 of the piston ring 34, thereby continuing to hold the first firing pin piston or driver 20 in a cocked condition. In other words, the gun does not fire upon initially pulling the "release-pull" trigger 100*b* of the embodiment of FIGS. 7A through 7D.

Figure 7C:
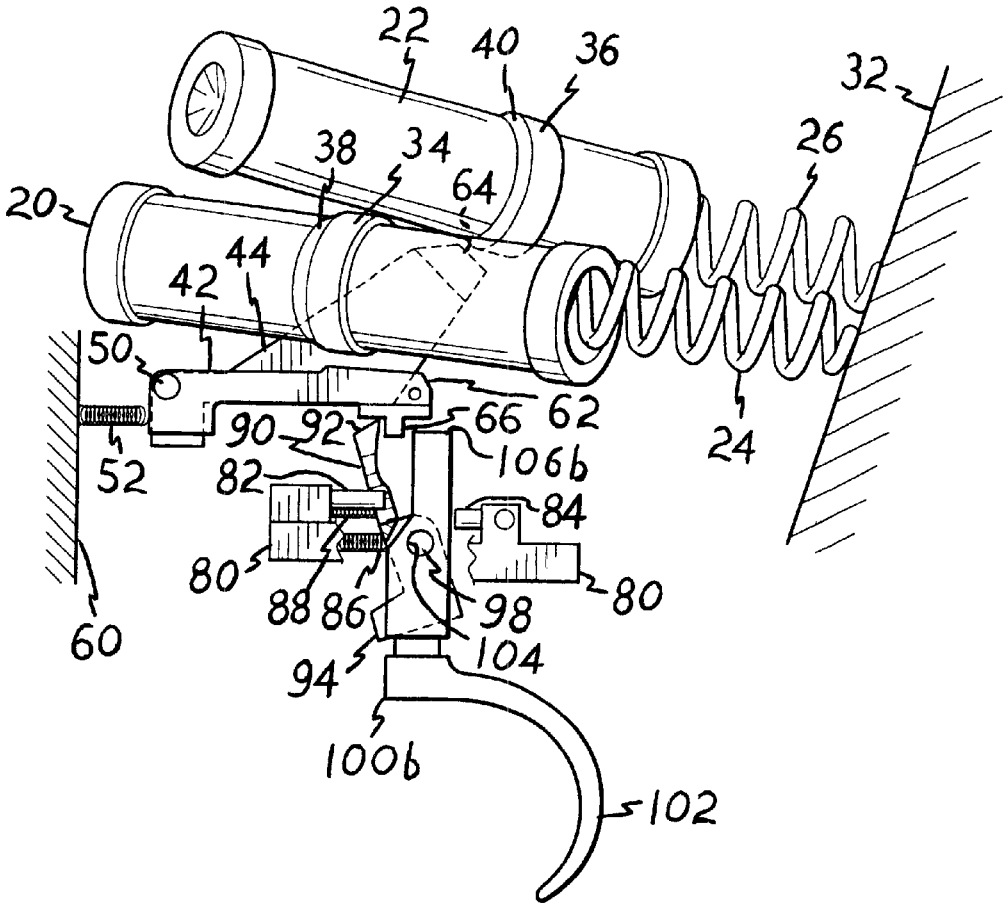

FIG. 7C illustrates the configuration when the trigger grip 102 is relaxed, with the trigger return spring 86 pushing the upper portion of the trigger assembly 100*b* rearwardly to push the trigger grip 102 forward. When this occurs, the first sear tang 66 catches upon the rearward edge of the sear tang land 92 of the release catch 90, due to that sear tang land 92 being slightly higher than the sear tang land 106*b* of the "release-pull" trigger 100*b*. This results in the first sear tang 66 pushing the release catch 92 forward to open a gap between the sear tang land 92 of the release catch and the first sear tang land 106*b* of the "release-pull" trigger 102*b*, thereby allowing the first sear tang 66 to fall between the two sear lands 92 and 106*b*, thus dropping the first sear 42 to release the first firing pin piston or driver 20 to fire the first barrel 16 when the trigger grip 102 is released after its initial pull. The second barrel remains unfired at this point, with the second sear tang 68 continuing to rest atop the sear tang land 92 of the release catch 90, thereby holding the second sear 44 upwardly in engagement with the ring 36 of the second piston 22.

Figure 7D:
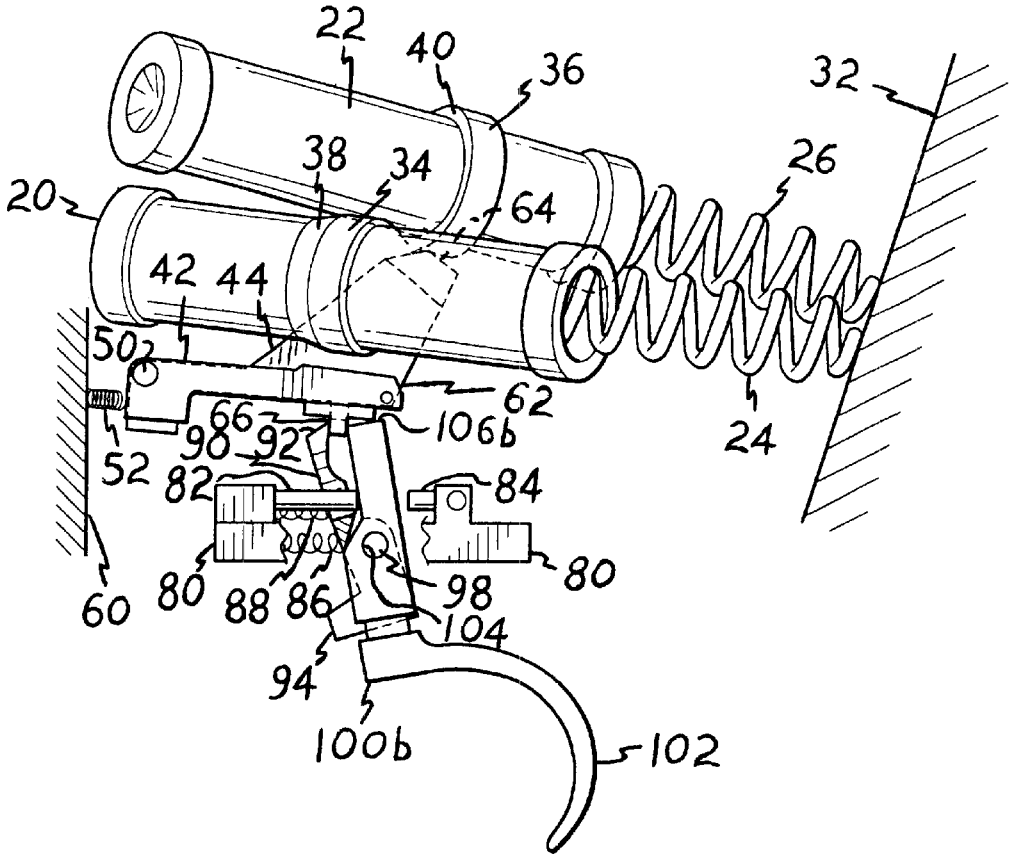

Finally, FIG. 7D illustrates the relationship of the; components when the trigger grip 102 is pulled rearwardly for a second time. When this occurs, the upper end or first sear contact land 106*b* of the trigger 100*b* contacts the back of the first sear tang 66, pushing the sliding first sear tang 66 forwardly in its channel 74 within the body of the first sear 42. As the first sear tang 66 moves forwardly, it also pushes the upper edge or sear tang land 92 of the release catch 90 forwardly, thereby pushing it from beneath the second sear tang 68 to allow the second sear tang 68 to fall to the rear of the release catch sear tang land 92. This results in the second sear 44 dropping, thereby releasing the second firing pin driver or piston 22 to fire the second barrel 18 of the firearm 10.

The above described mechanism of the "release-pull" trigger 100*b*, in combination with the remaining components of the present invention, results in the firing of one barrel of the double barreled gun when the trigger grip 102 is first released after an initial pull, and the firing of the second barrel when the trigger grip 102 is again pulled after the first release. This can be of value to the competitive skeet or trap shooter, in shooting "doubles," where two targets are launched simultaneously. The slight gain in time provided by not being required to release, and then again pull the trigger to fire the second shot, may make the difference between hitting the target and failing to get off a successful shot, in certain circumstances.

Figure 8:
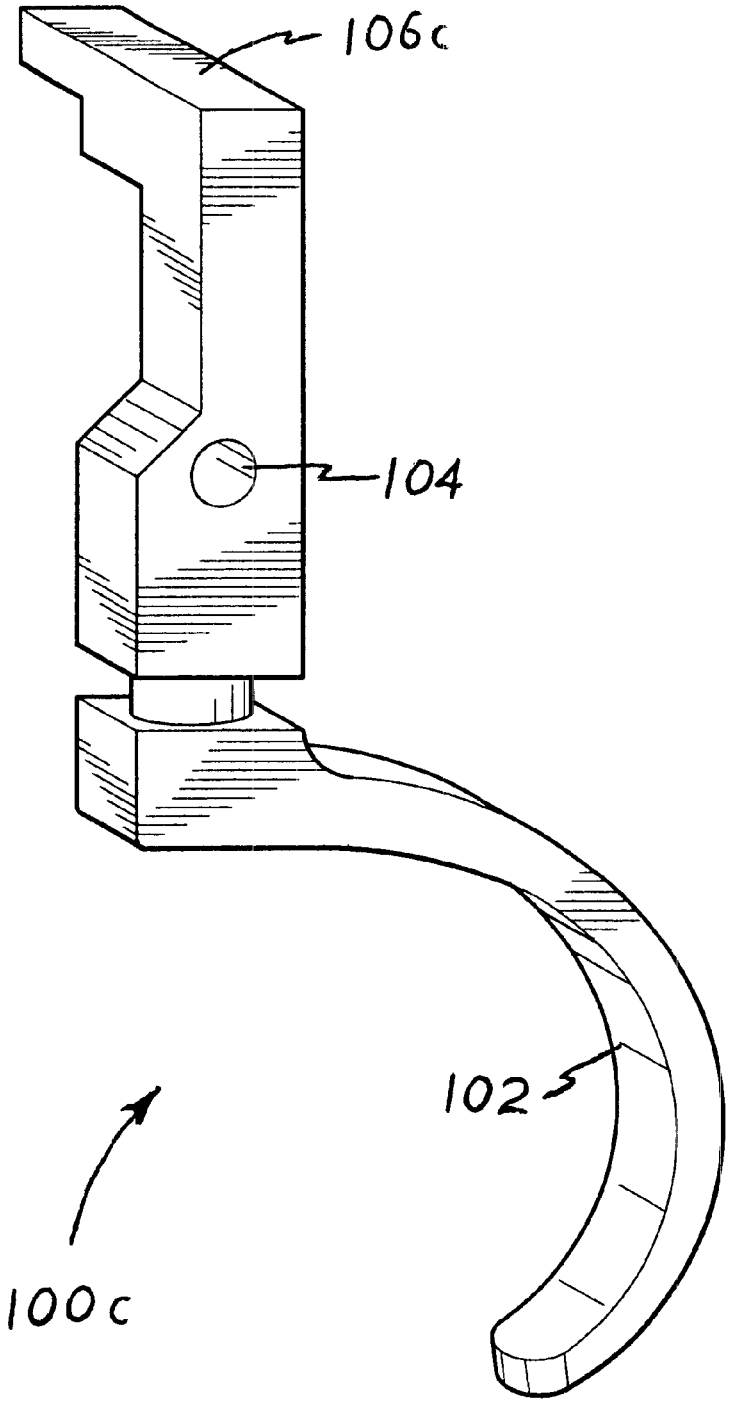
FIG. 8 is a detailed right side perspective view of the third embodiment trigger body, showing its configuration.

FIGS. 9A through 9E illustrate the steps involved in firing both barrels of the firearm 10, when the third embodiment "release-release" trigger 100*c* of FIG. 8 is used. In FIG. 8, the "release-release"trigger 100*c* includes a conventional trigger grip portion 102, as in the other trigger embodiments 100*a* and 100*b* of the present invention. However, the trigger 100*c* includes a relatively wide flange 106*c* comprising both a first and a second sear tang land, as opposed to the relatively narrow lands 106*a* (and button 108) and 106*b*, respectively of the two trigger mechanisms 100*a* and 100*b*. As described above, the first and second embodiment trigger mechanisms are relatively narrow, and do not engage the second sear tang 68. The relatively wide lateral flange or sear tang land 106*c* may be machined as shown in FIG. 8 with a series of supporting steps, or may have some other underlying configuration. The specific shape is not critical, so long as the sear tang land surface 106*c* is flat and sufficiently wide as to support both sear tangs 66 and 68 at various points during the operation of the mechanism.

Figure 9A:
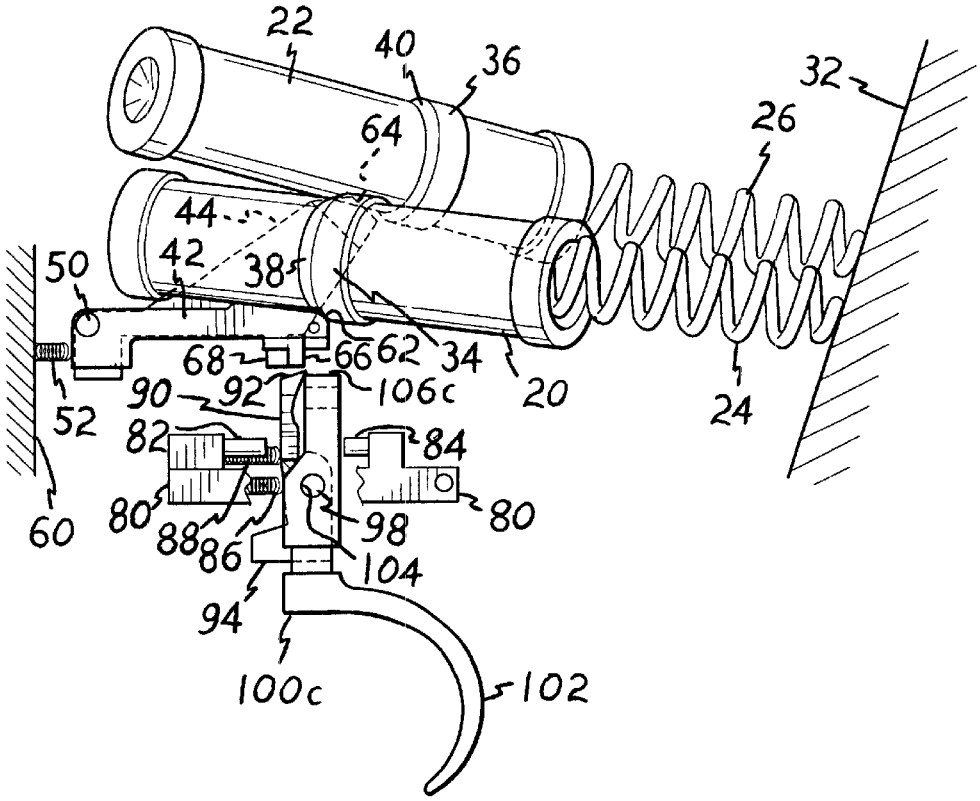
FIGS. 9A, 9B, 9C, 9D and 9E are side elevation views of the third embodiment firing mechanism, respectively showing the positions of the components when initially cocked, after a first trigger pull, after first trigger release, after a second trigger pull, and after a second trigger release.

In FIG. 9A, the mechanism is shown in its cocked condition, with both of the firing pin pistons or drivers 20 and 22 being rearwardly disposed against their respective compressed springs 24 and 26. The trigger finger grip 102 is in its forward position, with the opposite upper portion of the trigger 100*c* resting against the rear stop pin 84.

The release catch 90 is closely adjacent the upper portion of the trigger 100*c*, due to the return spring 88 which urges the release catch 90 toward the upper portion of the trigger 100*c*. The release catch 90 is pivotally secured to the trigger 100*c* by their common lateral pivot pin 98, as noted further above. The bifurcated lower legs or extensions 94 of the release catch 90 straddle the trigger body 100*c*, with the upper sear tang land 92 of the release catch 90 being positioned slightly above the flat first and second sear tang land 106*c* of the trigger 100*c*, i. e., with the release catch sear tang land 92 on the order of 0.02 inch (more or less) above the sear tang land 106*c* of the trigger 100*c*.

Figure 9B:
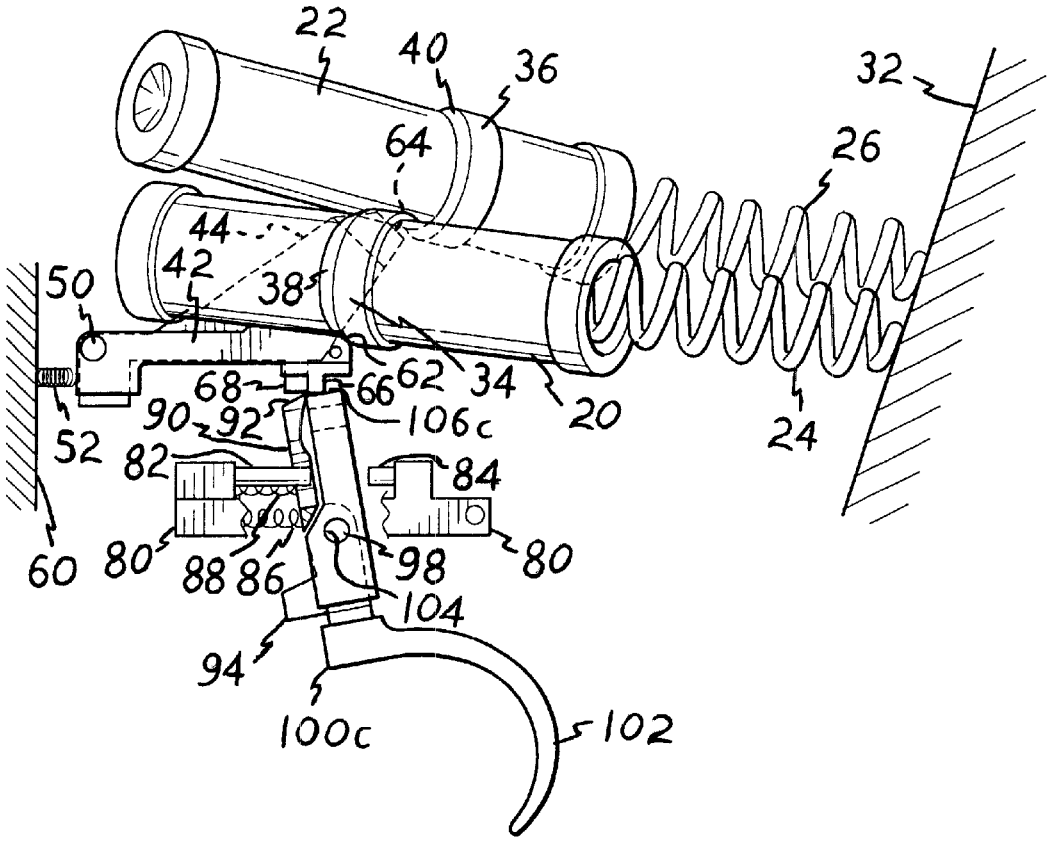

FIG. 9B illustrates the relative positions of the components when the "release-release" trigger mechanism 100*c* is initially pulled. When the trigger 100*c* is pulled rearwardly as shown, the upper portion pivots forwardly around the pivot pin 98. This pushes the upper end of the release catch 90 forwardly, along with its sear tang land 92, which moves forwardly of the first sear tang 66. When the first sear tang 66 is no longer supported by the release catch tang land 92, it falls slightly to rest atop the double sear tang land 106*c* of the "release-release" trigger 100*c*.

However, as the height of the sear tang land end 106*c* of the "release-release" trigger 100*c* is nearly the same as that of the sear tang land 92 of the release catch 90, the piston ring contact land 62 of the first sear 42 remains engaged with the chamfered edge 38 of the piston ring 34, thereby continuing to hold the first firing pin piston or driver 20 in a cocked condition. In other words, the gun does not fire upon initially pulling the "release release" trigger 100*c* of the embodiment of FIGS. 9A through 9E.

Figure 9C:
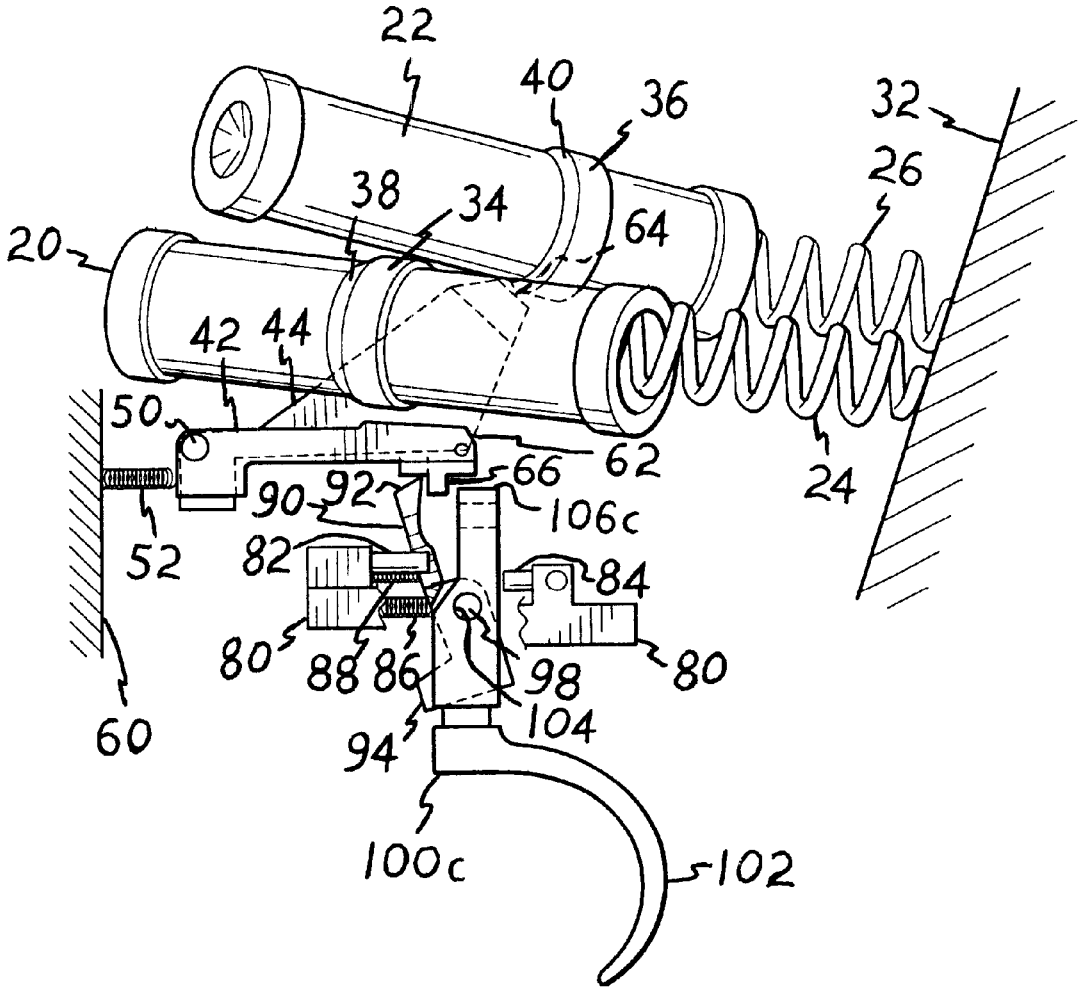

FIG. 9C illustrates the configuration when the trigger grip 102 is relaxed, with the trigger return spring 86 pushing the upper portion of the trigger mechanism 100*c* rearwardly to push the trigger grip 102 forward. When this occurs, the first sear tang 66 catches upon the rearward edge of the sear tang land 92 of the release catch 90, due to that sear tang land 92 being slightly higher than the first and second sear tang land 106*c* of the "release-release" trigger 100*c*. This results in the first sear tang 66 pushing the release catch 92 forward to open a gap between the sear tang land 92 of the release catch and the first sear tang land 106*c* of the "release-release" trigger 100*c*, thereby allowing the first sear tang 66 to fall between the two sear lands 92 and 106*c*, thus dropping the first sear 42 to release the first firing pin piston or driver 20 to fire the first barrel 16 when the trigger grip 102 is released after its initial pull. The second barrel remains unfired at this point, with the relatively wider (longitudinally) second sear tang 68 continuing to rest atop the sear tang land 92 of the release catch 90, thereby holding the second sear 44 upwardly in engagement with the ring 36 of the second piston 22.

Figure 9D:
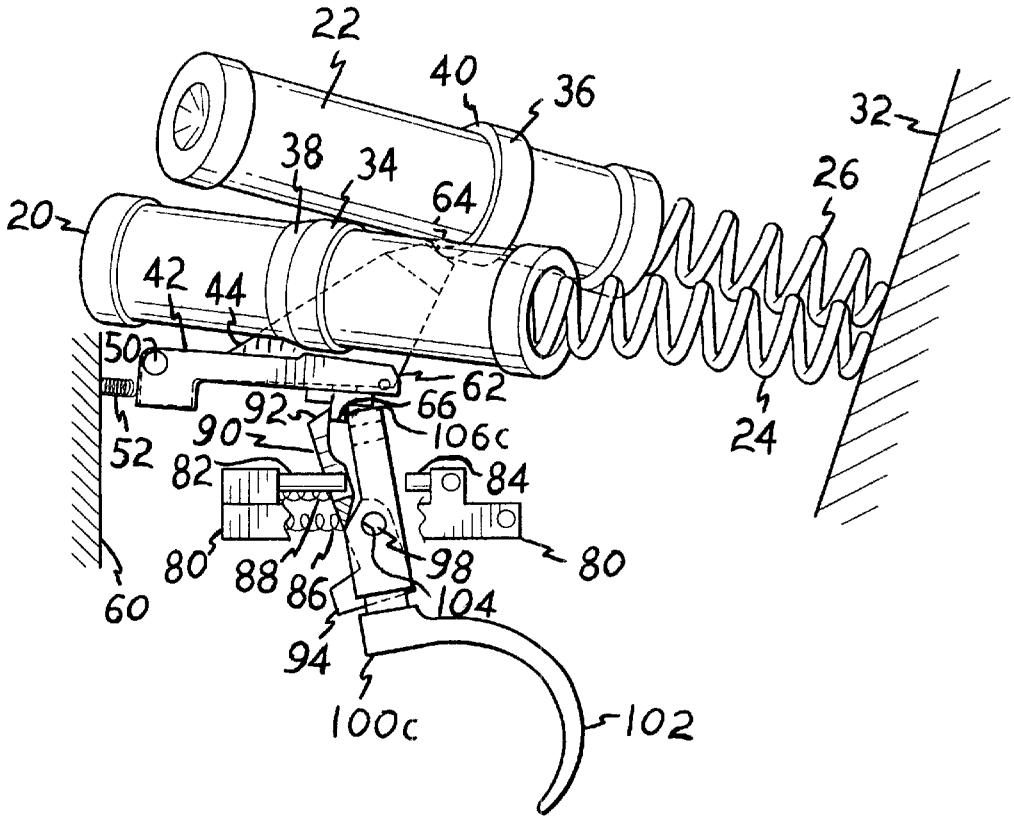

FIG. 9D illustrates the relationship of the components when the trigger grip 102 is pulled rearwardly for a second time. When this occurs, the upper end or first and second sear contact land 106*c* of the trigger 100c contacts the back of the first sear tang 66, pushing the sliding first sear tang 66 forwardly in its channel 74 within the body of the first sear 42. As the first sear tang 66 moves forwardly, it also pushes the upper edge or sear tang land 92 of the release catch 90 forwardly, thereby pushing it from beneath the second sear tang 68 to allow the second sear tang 68 to fall to the rear of the release catch sear tang land 92. This results in the second sear 44 dropping slightly downwardly onto the wide first and second sear tang land 106*c* of the trigger 100*c*, in the manners of the first sear tang 66 when the trigger grip 102 was initially pulled. As in the case of the first sear tang 66, the fall of the second sear tang 68 is insufficient to allow the second sear 44 to drop far enough to clear the chamfered ring 36 of the second firing pin driver or piston 22. This results in the second sear 44 continuing to hold the second piston 22 in a cocked position, with the second barrel 18 remaining unfired upon the second pull of the trigger 100*c*.

Figure 9E:
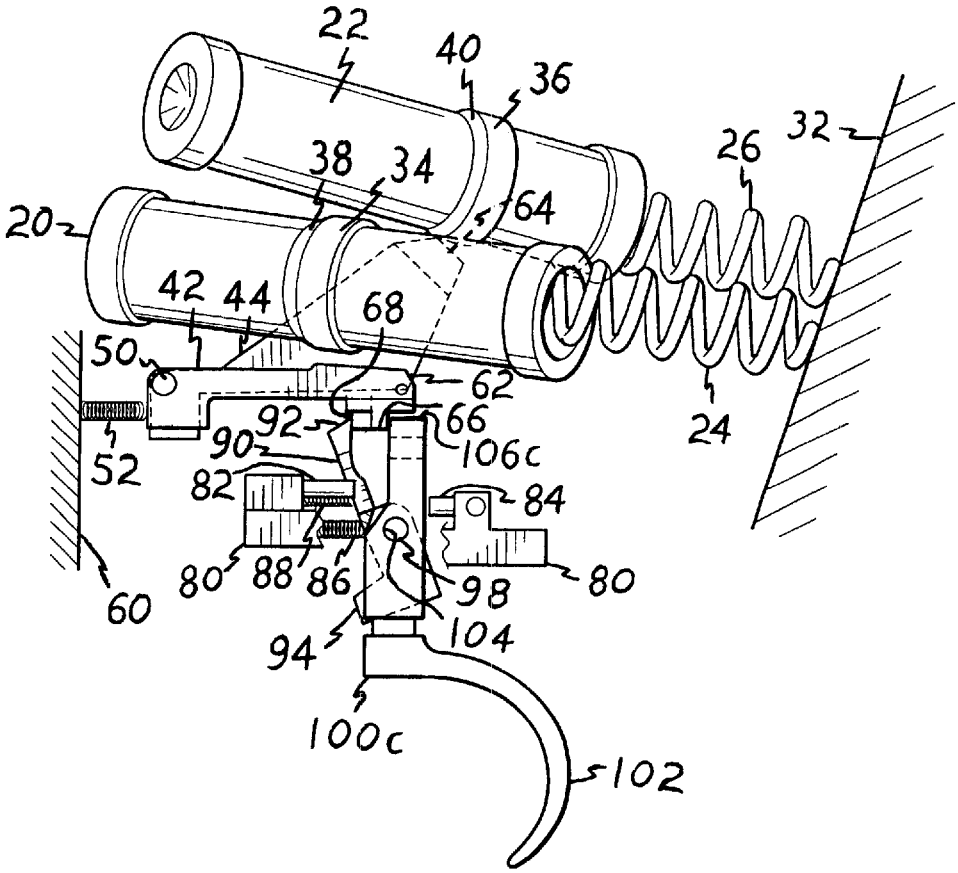

Finally, FIG. 9E illustrates the configuration of the components when the trigger grip 102 of the "release-release" trigger 100*c* is released for the second time, following the second pull. When this occurs, the second sear tang 68 now catches upon the rearward edge of the sear tang land 92 of the release catch 90, due to that sear tang land 92 being slightly higher than the first and second sear tang land 106*c* of the "release-release" trigger 100*c*. This results in the second sear tang 68 pushing the release catch 92 forward to open a gap between the sear tang land 92 of the release catch and the double sear tang land 106*c* of the "release-release" trigger 102*c*, thereby allowing the second sear tang 68 to fall between the two sear lands 92 and 106*c*, thus dropping the second sear 44 to release the second firing pin piston or driver 22 to fire the second barrel 18 when the trigger grip 102 is released after its initial pull.

The above described mechanism of the "release-release" trigger 100, in combination with the remaining components of the present invention, results in the firing of one barrel of the double barreled gun when the trigger grip 102 is first released after an initial pull, and the firing of the second barrel when the trigger grip 102 is again released after a second pull. This may be of value to the competitive skeet or trap shooter, in that the muscle contraction required for pulling a trigger can possibly throw off the aim of the shooter sufficiently to cause a target to be missed. The relaxation of the trigger finger for firing the firearm when the trigger is released, obviates this potential problem and leads to potentially greater shooting accuracy.

In conclusion, the present firearm mechanism embodiments provide numerous advantages over earlier developed single trigger mechanisms for firing double barrel firearms. The present mechanism is relatively simple, in that no inertial mechanisms are required which rely upon recoil of the firearm for their operation. Moreover, no separate selector switch or mechanism is required, as the present mechanism always fires the two barrels in the same sequence. Also, the vast majority of the components comprising the present mechanism are identical between each embodiment, with only the trigger mechanism of each embodiment differing from one another.

The three embodiments of the present invention provide completely different operating scenarios from one another, even though they are closely related. The first, or "pull-pull" embodiment, provides operation essentially identical to that of a conventional, double trigger, double barrel firearm, excepting that the shooter need only pull the same trigger successively to fire the two barrels of the firearm. The second, or "release-pull" embodiment, provides noticeably greater speed in completing two shots using a double barreled firearm constructed according to the present invention. The piston actuators or drivers for the firing pins of the firearm, also provide significantly more rapid response from the time the trigger is pulled (or released) to the time the firing pin contacts the primer of the shell or cartridge in the chamber of the firearm. Finally, the third embodiment, with its "release-release" trigger mechanism, overcomes the potential problem of muscle contraction affecting the aim of the firearm. The above described embodiments of the present invention will prove to be of great value to the discerning shooter, depending upon his or her specific interests and needs.

It is to be understood that the present invention is not limited to the embodiments described above, but encompasses any and all embodiments within the scope of the following claims.

I claim:

1. A double barrel firearm and single trigger sequential firing mechanism therefor, comprising in combination:

a gun having at least a first barrel, a second barrel, and a frame for housing a sequential firing mechanism therein;

a first and a second firing pin driver housed within said frame;

a first and a second firing pin driver retaining sear housed within said frame, with each said sear communicating with the respective said driver for selectively holding the respective said driver in a cocked condition;

a longitudinally sliding tang extending from said first firing pin driver retaining sear;

a fixed tang extending from said second firing pin driver retaining sear;

a single, pivotally disposed pull-pull trigger having a lower finger grip portion and an upper first sear tang land opposite said finger grip portion;

a selectively retractable and extendible first sear contact button disposed atop said upper first sear tang land of said trigger;

a release catch pivotally disposed in common with said trigger;

a wide, first and second sear tang land disposed atop said release catch and substantially coplanar with said first sear contact button of said upper first sear land of said trigger when said button is extended; and wherein said sliding tang of said first sear depresses said first sear contact button of said trigger when said trigger is pulled, dropping said first sear and releasing said first firing pin driver;

said sliding tang of said first sear catches upon and pivots said release catch away from said first sear contact button when said trigger is released, with said first sear contact button extending upwardly behind said sliding tang; and said first sear contact button pushes said sliding tang of said first sear forwardly against said first and second sear tang land of said release catch when said trigger is pulled, pivoting said release catch forwardly, dropping said fixed tang of said second sear from said release catch, dropping said second sear and releasing said second firing pin driver.

2. The double barrel firearm and single trigger sequential firing mechanism combination according to claim 1, wherein each said firing pin driver comprises a linearly actuating piston.

3. The double barrel firearm and single trigger sequential firing mechanism combination according to claim 2, further, including:

a circumferential sear contact ring disposed about each said piston;

a forward chamfer formed upon said sear contact ring of each said piston; and a rearwardly disposed, cooperatingly chamfered piston contacts ring land formed upon each said sear, for selectively retaining the respective said piston in a cocked condition.

4. The double barrel firearm and single trigger sequential firing mechanism combination according to claim 1, wherein said firearm is a shotgun.

5. The double barrel firearm and single trigger sequential firing mechanism combination according to claim 1, wherein said firearm has an over and under double barrel configuration.

6. The double barrel firearm and single trigger sequential firing mechanism combination according to claim 5, wherein:

said first and said second firing pin driver respectively comprise a first and a second linearly actuated piston;

said first piston being disposed generally beneath said second piston; and said first barrel being disposed beneath said second barrel.

7. A double barrel firearm and single trigger sequential firing mechanism therefor, comprising in combination:

a gun having at least a first barrel, a second barrel, and a frame for housing a sequential firing mechanism therein;

a first and a second firing pin driver housed within said frame;

a first and a second firing pin driver retaining sear housed within said frame, with each said sear communicating with the respective said driver for selectively holding the respective said driver in a cocked condition;

a longitudinally sliding tang extending from said first firing pin driver retaining sear;

a fixed tang extending from said second firing pin driver retaining sear;

a single, pivotally disposed release-pull trigger having a lower finger grip portion and an upper first sear tang land opposite said finger grip portion;

a release catch pivotally disposed in common with said trigger;

a wide, first and second sear tang land disposed atop said release catch and extending slightly above said upper first sear land of said trigger; and wherein said sliding tang of said first sear drops slightly when said trigger is pulled and rests upon said upper first sear land of said trigger, and retains said first firing pin driver in a cocked condition;

said sliding tang of said first sear catches upon and pivots said release catch away from said upper first sear land of said trigger when said trigger is released, dropping said sliding tang of said first sear between said release catch and said upper first sear land of said trigger and releasing said first firing pin driver; and said upper first sear land of said trigger pushes said sliding tang of said first sear forwardly against said first and second sear tang land of said release catch when said trigger is pulled, pivoting said release catch forwardly, dropping said fixed tang of said second sear from said release catch, dropping said second sear and releasing said second firing pin driver.

8. The double barrel firearm and single trigger sequential firing mechanism combination according to claim 7, wherein each said firing pin driver comprises a linearly actuating piston.

9. The double barrel firearm and single trigger sequential firing mechanism combination according to claim 8, further including:

a circumferential sear contact ring disposed about each said piston;

a forward chamfer formed upon said sear contact ring of each said piston; and a rearwardly disposed, cooperatingly chamfered piston contact ring land formed upon each said sear, for selectively retaining the respective said piston in a cocked condition.

10. The double barrel firearm and single trigger sequential firing mechanisms combination according to claim 7, wherein said firearm is a shotgun.

11. The double barrel firearm and single trigger sequential firing mechanism combination according to claim 7, wherein said firearm has an over and under double barrel configuration.

12. The double barrel firearm and single trigger sequential firing mechanism combination according to claim 11, wherein:

said first and said second firing pin driver respectively comprise a first and a second linearly actuated piston;

said first piston being disposed generally beneath said second piston; and said first barrel being disposed beneath said second barrel.

13. A double barrel firearm and single trigger sequential firing mechanism therefor, comprising in combination:

a gun having at least a first barrel, a second barrel, and a frame for housing a sequential firing mechanism therein;

a first and a second firing pin driver housed within said frame;

a first and a second firing pin driver retaining sear housed within said frame, with each said sear communicating with the respective said driver for selectively holding the respective said driver in a cocked condition;

a longitudinally sliding tang extending from said first firing pin driver retaining sear;

a fixed tang extending from said second firing pin driver retaining sear;

a single, pivotally disposed release-release trigger having a lower finger grip portion and a wide, upper first and second sear tang land opposite said finger grip portion;

a release catch pivotally disposed in common with said trigger;

a wide, first and second sear tang land disposed atop said release catch and extending slightly above said upper first and second sear land of said trigger; and wherein said sliding tang of said first sear drops slightly when said trigger is pulled and rests upon said upper first and second sear land of said trigger, and retains said first firing pin driver in a cocked condition;

said sliding tang of said first sear catches upon and pivots said release catch away from said upper first and second sear land of said trigger when said trigger is released, dropping said sliding tang of said first sear between said release catch and said upper first and second sear land of said trigger and releasing said first firing pin driver;

said upper first and second sear land of said trigger pushes said sliding tang of said first sear forwardly against said first and second sear tang land of said release catch when said trigger is pulled, pivoting said release catch forwardly and dropping said tang of said second sear slightly to rest atop said upper first and second sear land of said trigger and retaining said second firing pin driver in a cocked condition; and said tang of said second sear catches upon and pivots said release catch away from said upper first and second sear land of said trigger when said trigger is released, dropping said tang of said second sear from said upper first and second sear land of said trigger, dropping said second sear and releasing said second firing pin driver.

14. The double barrel firearm and single trigger sequential firing mechanism combination according to claim 13, wherein each said firing pin driver comprises a linearly actuating piston.

15. The double barrel firearm and single trigger sequential firing mechanism combination according to claim 14, further including:

a circumferential sear contact ring disposed about each said piston;

a forward chamfer formed upon said sear contact ring of each said piston; and a rearwardly disposed, cooperatingly chamfered piston contact ring land formed upon each said sear, for selectively retaining the respective said piston in a cocked condition.

16. The double barrel firearm and single trigger sequential firing mechanism combination according to claim 14, wherein said firearm is a shotgun.

17. The double barrel firearm and single trigger sequential firing mechanism combination according to claim 14, wherein said firearm has an over and under double barrel configuration.

18. The double barrel firearm and single trigger sequential firing mechanism combination according to claim 17, wherein:

said first and said second firing pin driver respectively comprise a first and a second linearly actuated piston;

said first piston being disposed generally beneath said second piston; and said first barrel being disposed beneath said second barrel.

* * * * *